US010662685B2

(12) United States Patent
Proetta

(10) Patent No.: US 10,662,685 B2
(45) Date of Patent: May 26, 2020

(54) DOOR STOP AND METHOD OF USING SAME

(71) Applicant: Anthony Proetta, Waxhaw, NC (US)

(72) Inventor: Anthony Proetta, Waxhaw, NC (US)

( * ) Notice: Subject to any disclaimer, the term of this patent is extended or adjusted under 35 U.S.C. 154(b) by 78 days.

(21) Appl. No.: 15/453,491

(22) Filed: Mar. 8, 2017

(65) Prior Publication Data

US 2017/0298672 A1 Oct. 19, 2017

Related U.S. Application Data

(60) Provisional application No. 62/305,021, filed on Mar. 8, 2016.

(51) Int. Cl.
*E05F 5/02* (2006.01)
*E05C 17/44* (2006.01)

(52) U.S. Cl.
CPC ..... *E05C 17/446* (2013.01); *E05C 17/44* (2013.01)

(58) Field of Classification Search
CPC ..... Y10T 16/61; E05C 17/446; E05C 17/44
USPC ..... 16/82
See application file for complete search history.

(56) References Cited

U.S. PATENT DOCUMENTS

| | | | | |
|---|---|---|---|---|
| 2,726,109 | A * | 12/1955 | Bennett | E05C 17/446 292/153 |
| 2,762,641 | A | 9/1956 | Gilmour | |
| 3,328,065 | A | 9/1965 | Arenson | |
| 4,673,203 | A | 6/1987 | Chezem | |
| 4,782,553 | A | 11/1988 | Morrison | |
| 5,131,701 | A | 7/1992 | Stepniewski | |
| D388,696 | S | 1/1998 | Troy | |
| 7,065,830 | B2 | 6/2006 | Bushey | |
| 7,412,751 | B2 | 8/2008 | Forrest | |
| 8,186,011 | B2 | 5/2012 | Rooney | |
| 9,267,317 | B2 | 2/2016 | Vu | |
| 2005/0193520 | A1 | 9/2005 | Bushey | |

FOREIGN PATENT DOCUMENTS

| | | | | |
|---|---|---|---|---|
| DE | 822057 C | * | 11/1951 | E05C 17/446 |
| DE | 10336433 A1 | * | 3/2005 | E05C 17/56 |
| EP | 2325082 A2 | * | 5/2011 | B64C 1/14 |
| FR | 2244363 A5 | * | 4/1975 | E05B 43/00 |
| GB | 191129391 A | * | 8/1912 | E05C 17/446 |
| GB | 141917 A | * | 4/1920 | E05C 17/446 |

* cited by examiner

*Primary Examiner* — Jerry E Redman
(74) *Attorney, Agent, or Firm* — Ashley Law Firm P.C.; Stephen S. Ashley, Jr.

(57) ABSTRACT

A door stop comprises an elongate threaded member having a flat head section, such as a flat head bolt or elevator bolt, and a mounting panel carried on the threaded member. A cushioning member made of felt or other soft non-abrasive material can be positioned on the head section. A locking nut can be threaded on the threaded member, with the mounting panel between the locking nut and the head section. An alternative door stop comprises a spring-loaded member, and an elongate rod telescopically positioned within the spring-loaded member and adapted for sliding movement therein. A mounting panel can be formed on the spring-loaded member. A head section can be positioned on one end of the rod, and a cushioning member, made of felt or other soft, non-abrasive material can be attached to the outer surface of the head section.

19 Claims, 17 Drawing Sheets

DOOR STOP AND METHOD OF USING SAME

CROSS REFERENCE TO RELATED APPLICATIONS

This application claims priority to U.S. Provisional Application No. 62/305,021, filed Mar. 8, 2017, and which is incorporated herein by reference.

TECHNICAL FIELD OF INVENTION

The present invention relates to the mechanical arts. An embodiment of the invention comprises a door stop. Another embodiment of the invention comprises a method of installing and using a door stop.

BACKGROUND OF INVENTION

Door stops are known in the art for preventing doors from directly contacting and damaging a wall proximate the door and/or maintaining doors in a fixed position. There are known door stops that are typically mounted to a baseboard, wall, or door, and prevent contact between the door and the wall by acting as an obstruction between the door and the wall, which contacts the wall before the door does, thereby preventing direct contact between the door and the wall. However, such door stops can cause damage to the wall when a door is opened with substantial force. Furthermore, such door stops cannot maintain in a particular position. Other known door stops completely immobilize the door. Such door stops typically do not contact the wall, however, they can be inconvenient to use as they require a user to remove (or at least move) the door stop whenever it is desired to move the door.

SUMMARY OF INVENTION

One object of the present invention is to provide a door stop that does not contact an adjacent door or wall. Another object of the invention is to provide a door stop that can maintain a door in a variety of fixed positions. These and other objects of the invention can be achieved in the various embodiments of the invention described herein.

One embodiment of the invention comprises a door stop apparatus comprising an elongate member having a head section positioned at one end thereof, and a mounting plate carried on the elongate member. The distance from the head section to the mounting plate is selectively adjustable.

Another embodiment of the invention comprises a method of using the door stop apparatus to prevent unwanted movement of a door. The method includes providing a substantially rectangular door in a structure having a ceiling and a floor. The door has a top edge surface proximate the ceiling, a bottom edge surface proximate the floor, and first and second opposed side edge surfaces intermediate the top edge surface and the bottom edge surface. The distance from the head section to the mounting plate can be adjusted to conform to the distance from the bottom edge surface of the door to the floor. A cavity can be formed in the bottom edge surface of the door, and a portion of the elongate member can be positioned in the cavity. The mounting plate is positioned against the bottom edge surface of the door, and at least one fastening member is inserted through an opening formed in the mounting plate and into the bottom edge surface of the door to attach the door stop apparatus to the bottom edge surface of the door. The head section is positioned on the floor, wherein the head section provides a level of frictional engagement with the floor that prevents unwanted movement of the door when the door is unattended by a user and allows for movement of the door when the user applies force to the door. The head section can include a cushioning section comprised of a soft, non-abrasive material, such as felt or polyurethane foam, for contacting the floor.

According to another embodiment of the invention, the elongate member includes an outer surface having threads formed thereon, and a locking nut is carried on the elongate member and is threadingly engaged thereto. The mounting panel is positioned intermediate the locking nut and the head section and adjacent to the locking nut. The distance from the head section to the mounting plate can be adjusted to conform to the distance from the bottom edge surface of the door to the floor by moving the locking nut on the elongate member thereby allowing for the mounting plate to be moved on the elongate member.

According to another embodiment of the invention, the elongate member is comprised of a spring-loaded member and an elongate rod. A first portion of the elongate rod is telescopically positioned within the spring-loaded member and adapted for sliding movement within spring loaded member. A second portion of the elongate rod is positioned exterior to the spring-loaded member. The distance from the head section to the mounting plate adjusts to conform to the distance from the bottom edge surface of the door to the floor by the movement of the elongate rod within spring loaded member.

Another embodiment of the invention comprises a door stop apparatus comprising an elongate threaded member having a substantially flat head section positioned at one end of the elongate threaded member, and a locking nut carried on the threaded member and threadingly engaged to the threaded member. A mounting panel has a central opening formed therein for receiving the threaded member therethrough. The mounting panel is carried on the threaded member intermediate the locking nut and the head section of the threaded member and is positioned adjacent to the locking nut. The mounting panel is adapted for attachment to a bottom edge surface of a door. The distance from the mounting panel to the head section is adjustable by moving the locking nut on the threaded member.

According to another embodiment of the invention, a cushioning section is positioned on the outer surface of the head section, and is adapted for frictionally engaging the floor surface.

According to another embodiment of the invention, the cushioning section is comprised of felt and/or polyurethane foam.

According to another embodiment of the invention, the mounting plate has first and second apertures formed therein, and the central opening is positioned between the first and second apertures. A first fastening member is positioned through the first aperture, and a second fastening member is positioned through the second aperture. The first and second fastening members are adapted for being inserted into the bottom edge surface of the door, whereby the mounting plate is attached to the bottom edge surface of the door.

According to another embodiment of the invention, the first and second fastening members are wood screws.

According to another embodiment of the invention, the threaded member and the mounting plate are comprised of steel.

According to another embodiment of the invention, the locking nut is comprised of nylon and/or plastic.

According to another embodiment of the invention, the elongate threaded member can be a flat head bolt or an elevator bolt.

A door stop apparatus according to another embodiment of the invention comprises a spring-loaded member, and an elongate rod telescopically positioned within the spring-loaded member and adapted for sliding movement within spring loaded member. A first portion of the elongate rod is positioned within the spring-loaded member and a second portion of the elongate rod is positioned exterior to the spring-loaded member. A head section is positioned on the second portion of the elongate rod, and is adapted for frictionally engaging a floor surface.

According to another embodiment of the invention, a mounting panel is attached to the spring-loaded member. The mounting panel is adapted for attaching to a bottom edge surface of a door. The distance from the head section to the mounting panel is varied by the sliding movement of the elongate rod within spring-loaded member.

According to another embodiment of the invention, the mounting plate includes a central opening that receives the spring-loaded member therethrough.

According to another embodiment of the invention, the mounting plate includes first and second apertures formed therein. The central opening is positioned intermediate the first and second apertures. A first fastening member is positioned through the first aperture, and a second fastening member is positioned through the second aperture. The first and second fastening members are adapted for being inserted into the bottom edge surface of the door, whereby the mounting plate is attached to the bottom edge surface of the door. The first and second fastening members can be wood screws.

According to another embodiment of the invention, a cushioning section comprised of a soft, non-abrasive material, such as felt or polyurethane foam, is positioned on an outer surface of the head section.

DETAILED DESCRIPTION OF PREFERRED EMBODIMENTS OF INVENTION

Figure 1:
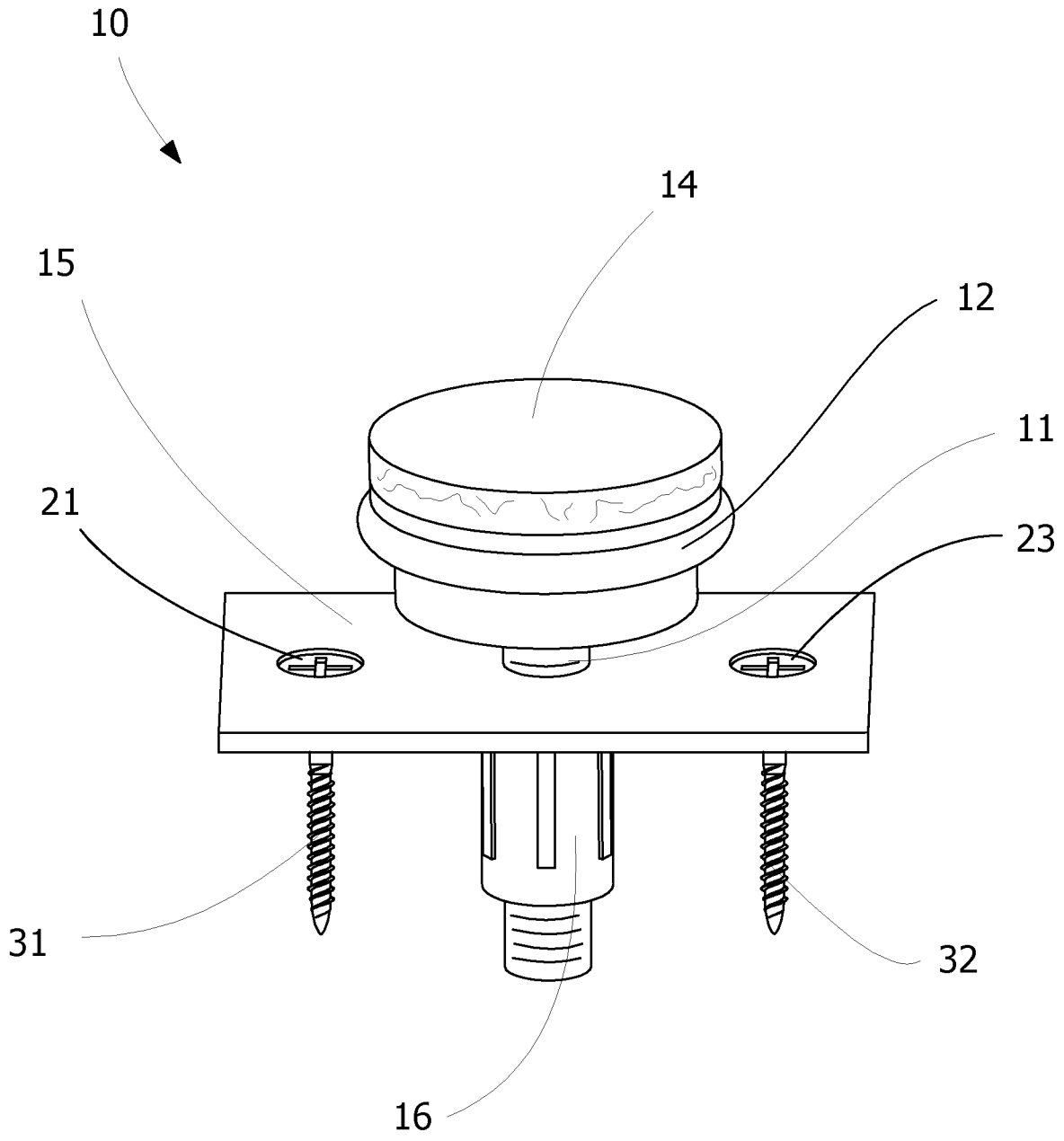
FIG. 1 is a perspective view of a door stop according to a preferred embodiment of the invention.
Figure 2:
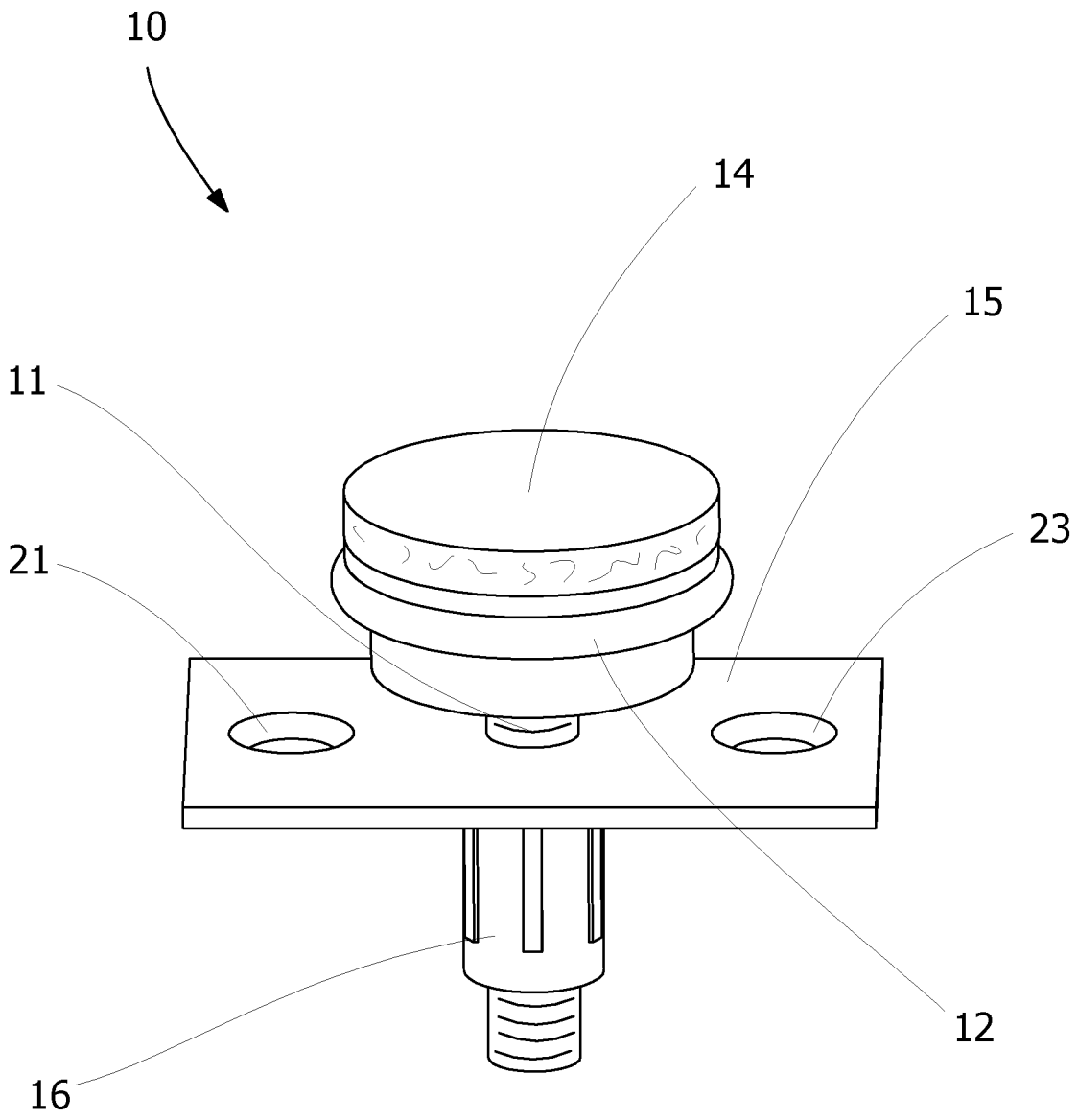
FIG. 2 is another perspective view of the door stop of FIG. 1.
Figure 3:
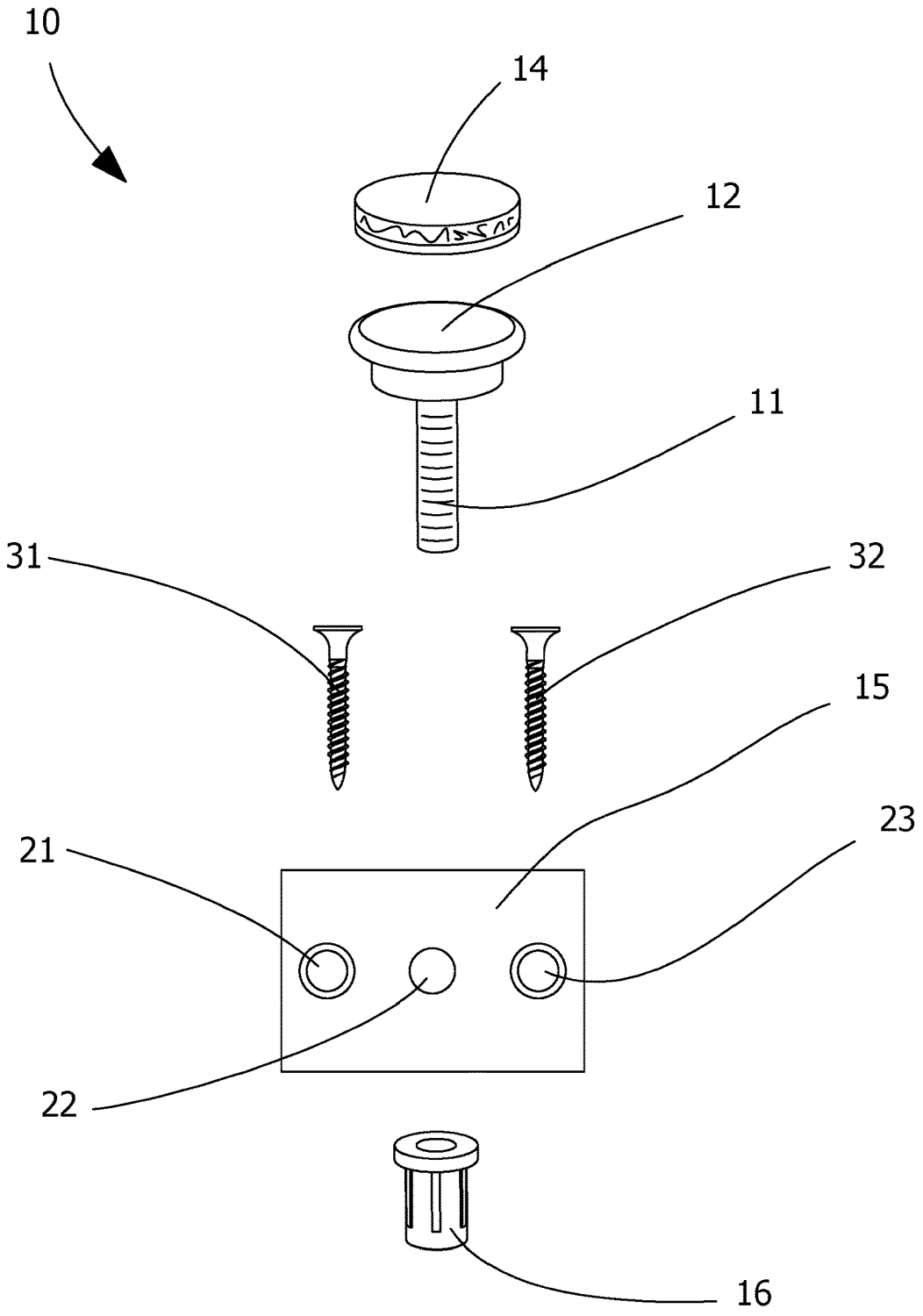
FIG. 3 is an exploded view of the door stop of FIG. 1.
Figure 4:
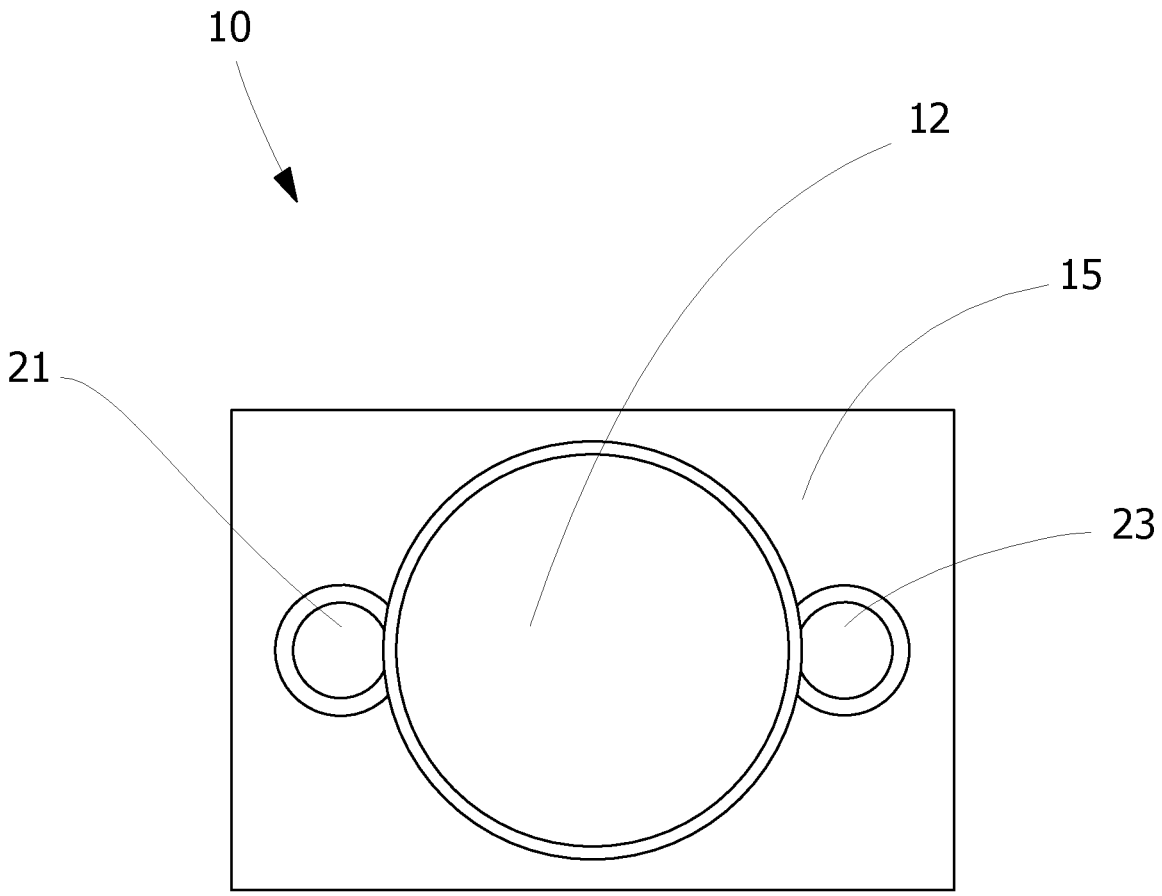
FIG. 4 is a partial top plan view of the door stop of FIG. 1.

A door stop according to a preferred embodiment of the invention is illustrated in FIGS. 1-8, and shown generally at reference numeral 10. As shown in FIGS. 1-3, the door stop 10 comprises an elongate threaded member 11 and a substantially flat and rectangular mounting panel 15. The threaded member 11 and the mounting panel 15 can be made of steel or other suitable material.

The elongate threaded member 11 includes a substantially flat and circular head section 12 at one end thereof, as shown in FIGS. 1-4. The head section 12 has a diameter substantially greater than the rest of the threaded member 11. The threaded member 11 can be a flat head bolt, elevator bolt, or other suitable elongate member having threads formed thereon.

A cushioning section 14 can be attached to the outer surface of the head section 12, as shown in FIGS. 1-3. The cushioning section 14 can be made of felt, polyurethane foam or other soft, non-abrasive material. The cushioning section 14 can be attached to the head section 12 by an adhesive or by other suitable attachment means.

Figure 5:
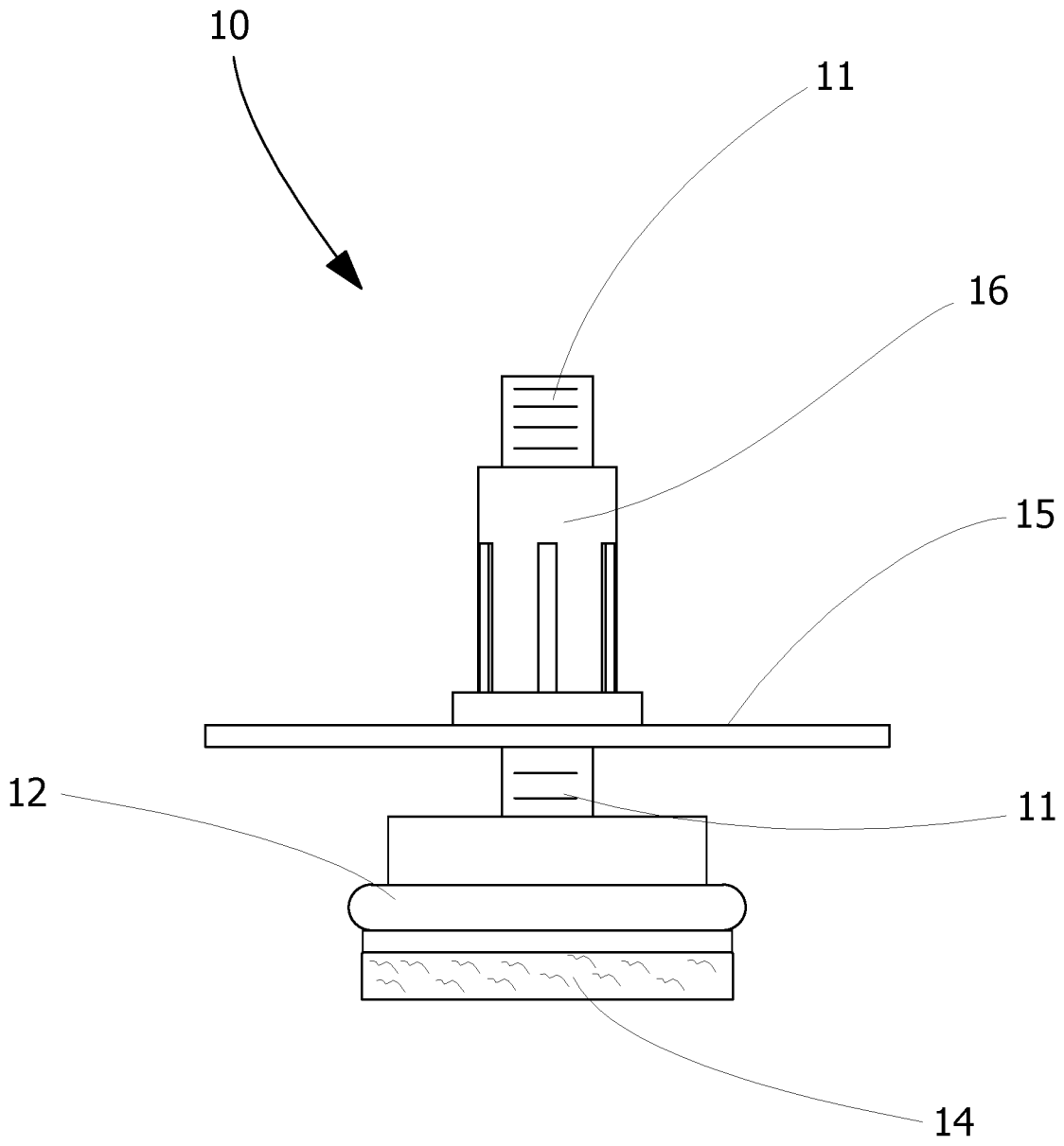
FIG. 5 is a front elevation of the door stop of FIG. 1.
Figure 6:
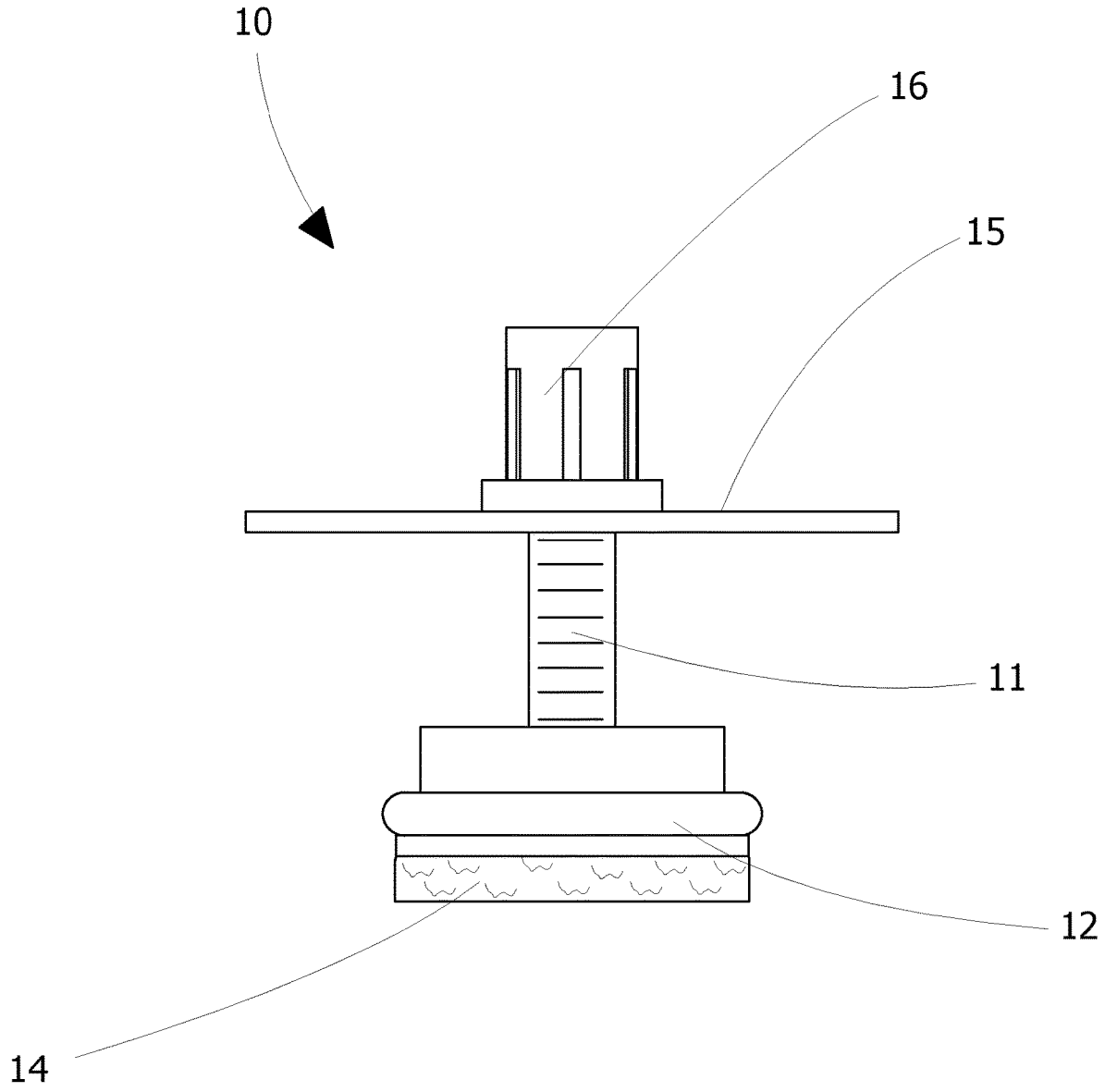
FIG. 6 is another front elevation of the door stop of FIG. 1.

The mounting panel 15 has three round holes 21, 22, 23 formed therein and positioned linearly, as shown in FIG. 3. The center hole 22 is shaped and sized to receive the elongate portion the threaded member 11 there through, as shown in FIG. 2. The head section 12 has a substantially greater diameter than the center hole 22, thereby preventing the threaded member from moving completely through the center hole 22. A locking nut 16 can be threaded on the threaded member 11, with the mounting panel 15 intermediate the locking nut 16 and the head section 12, as shown in FIGS. 5 and 6. The locking nut 16 can be made of nylon, plastic, or other suitable material.

Figure 7:
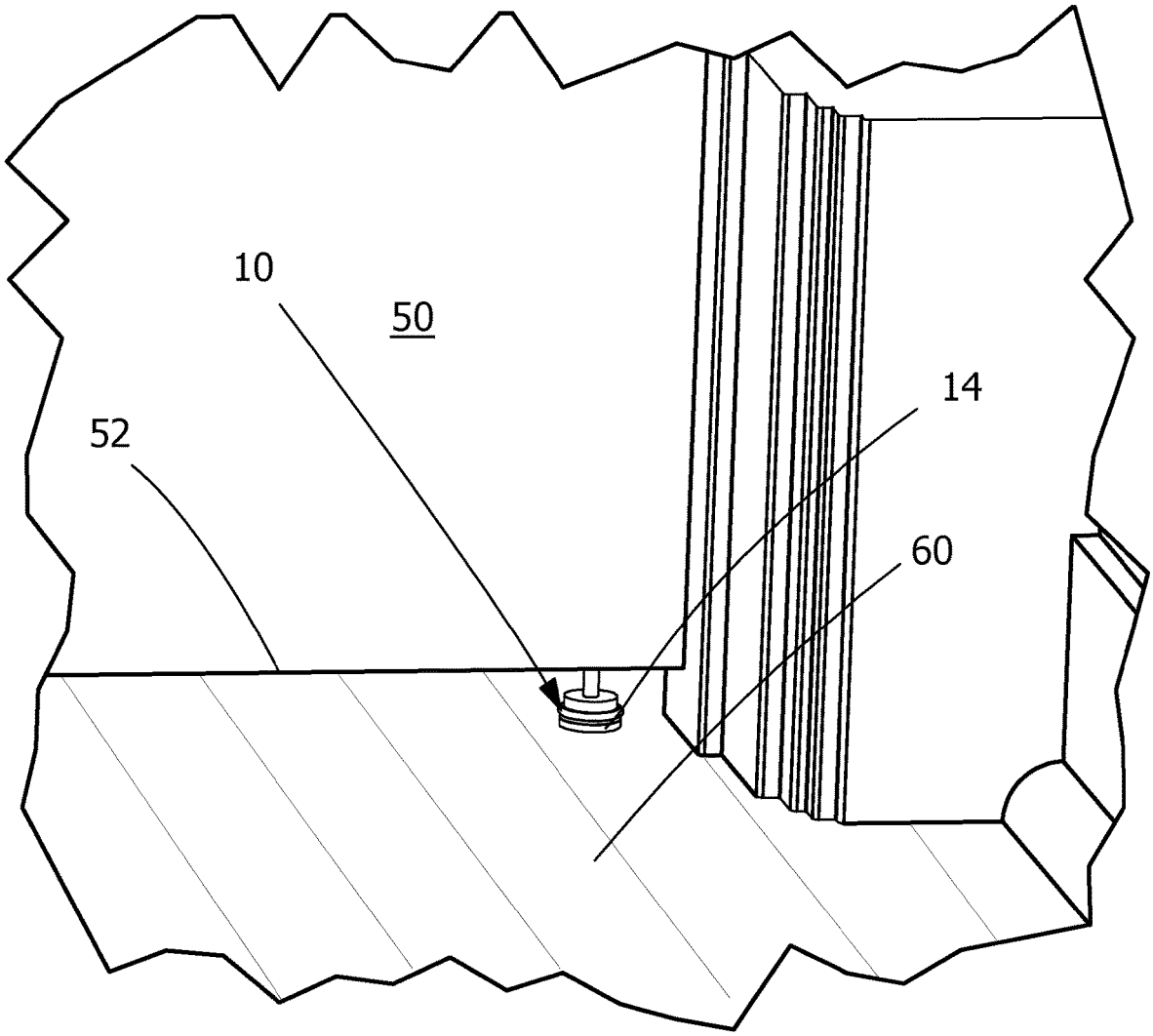
FIG. 7 is an environmental view of the door stop of FIG. 1.
Figure 8:
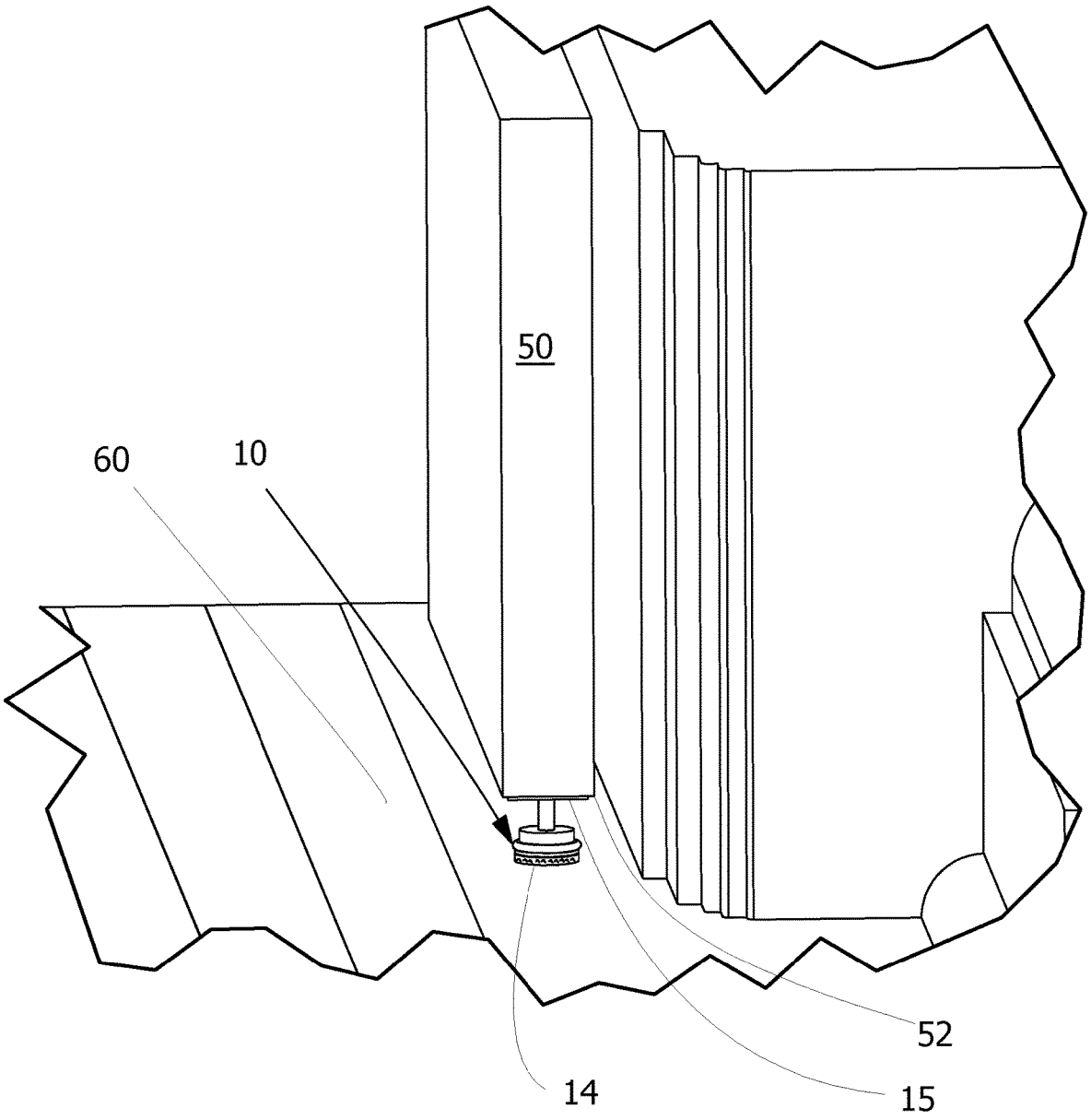
FIG. 8 is another environmental view of the door stop of FIG. 1.

The door stop 10 can be attached at the bottom edge 52 of a door 50, as shown in FIGS. 7 and 8. A cavity can be formed in the bottom edge 52 of the door 50 to receive a portion of the threaded member 11. The cavity can be formed using a drill or other suitable means. The distance between from the bottom edge 52 of the door and the floor can vary with various doors. The effective length of the door stop 10 can be adjusted accordingly by adjusting the position of the threaded member 11 in relation to the locking nut 16. Rotating the threaded member 11 clockwise reduces the effective length of the door stop 10, as illustrated in FIG. 5. Rotating the threaded member 11 counter-clockwise increases the effective length of the door stop 10, as illustrated in FIG. 6. When the distance from the mounting panel 15 to the cushioning section 14 is approximately equal to the distance from the bottom edge 52 of the door 50 to the floor 60, the locking pin 16 and the portion of the threaded member 11 extending above the mounting panel 15 can be positioned within the bottom edge 52 of the door 50, with the mounting panel 15 positioned flat against the bottom edge 52 of the door 50. Fastening members such as wood screws 31, 32 are positioned through the left and right side openings 21, 23 of the mounting panel 15, as shown in FIG. 1, and screwed into the bottom edge 52 of the door 50 to securely attach the door stop 10 to the door 50.

With the door stop 10 secured to the bottom edge 52 of the door 50, the door stop 10 can prevent unwanted movement of the door 50. The cushioning section 14 contacts the floor 60 and provides a level of frictional engagement that keeps the door 50 in a fixed position when not being moved by a person. The cushioning section 14 provides a level of frictional engagement such that the door 50 can be opened and closed when reasonable force is applied to the door, but stops the door 50 and maintains it in a fixed position when a person is not moving the door 50. There is no risk of the door stop 10 damaging an adjacent door or wall. The soft material of the cushioning section 14 prevents the door stop 10 from scratching the floor 60.

Figure 9:
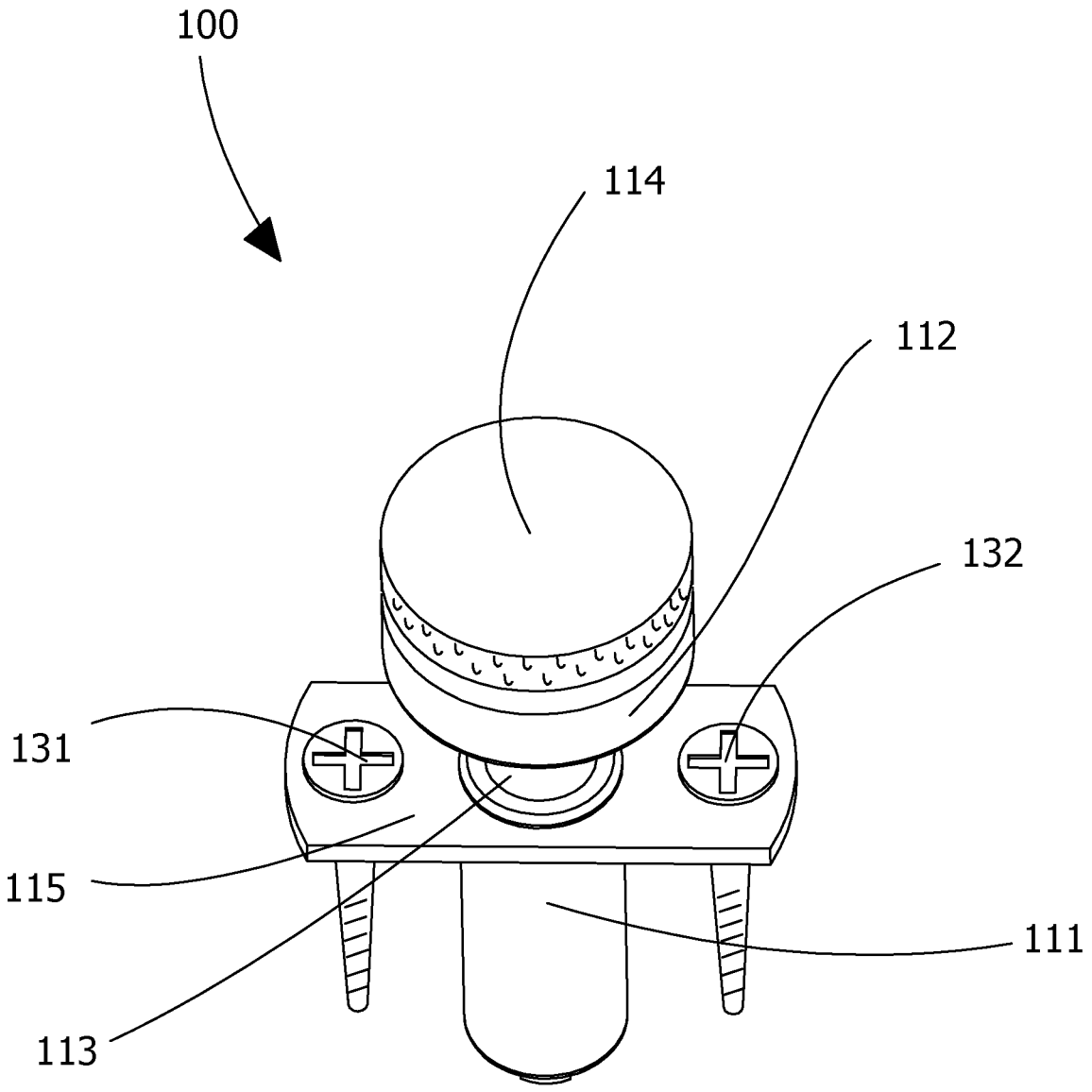
FIG. 9 is a perspective view of a door stop according to another preferred embodiment of the invention.
Figure 10:
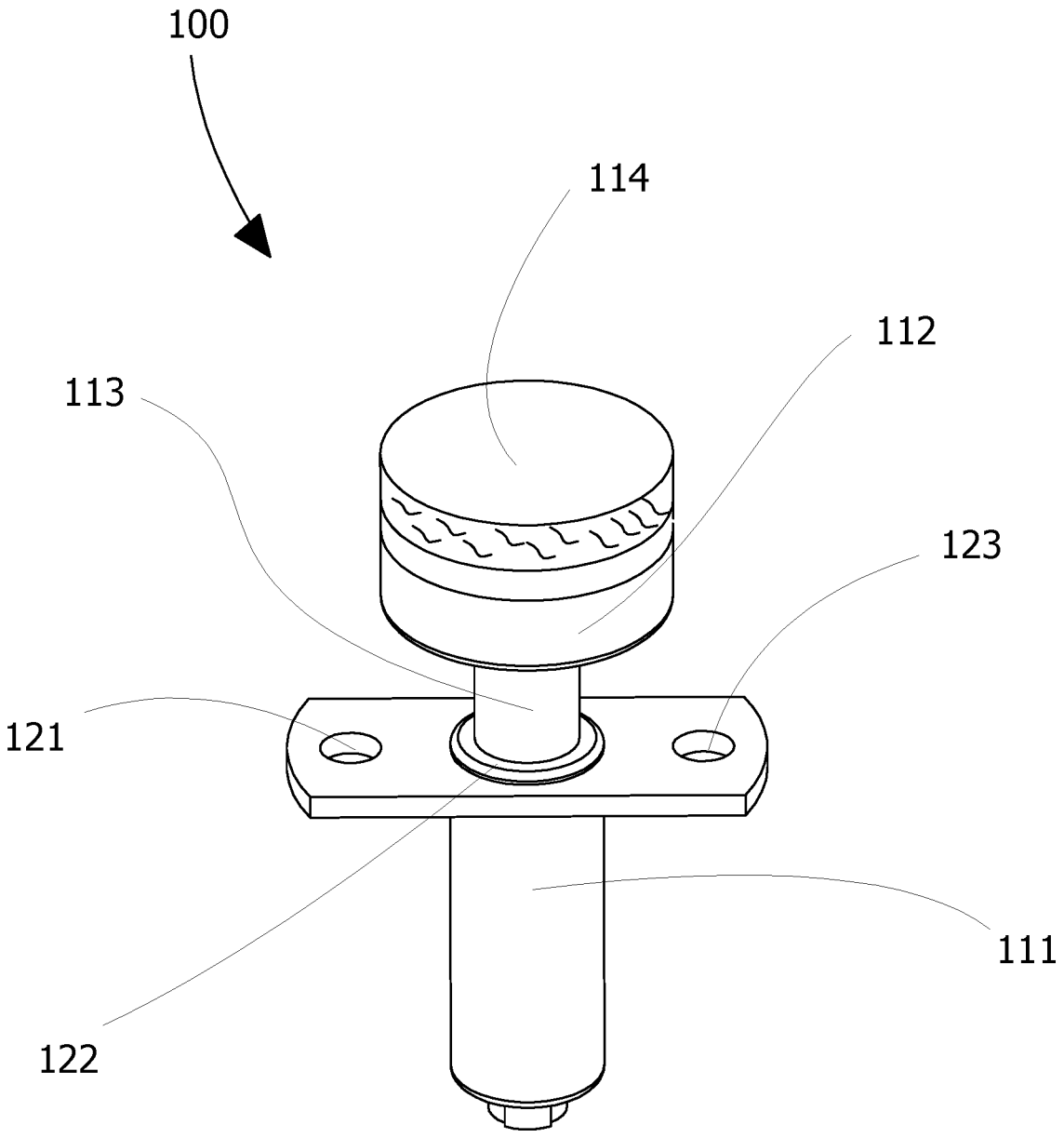
FIG. 10 is another perspective view of the door stop of FIG. 9.
Figure 11:
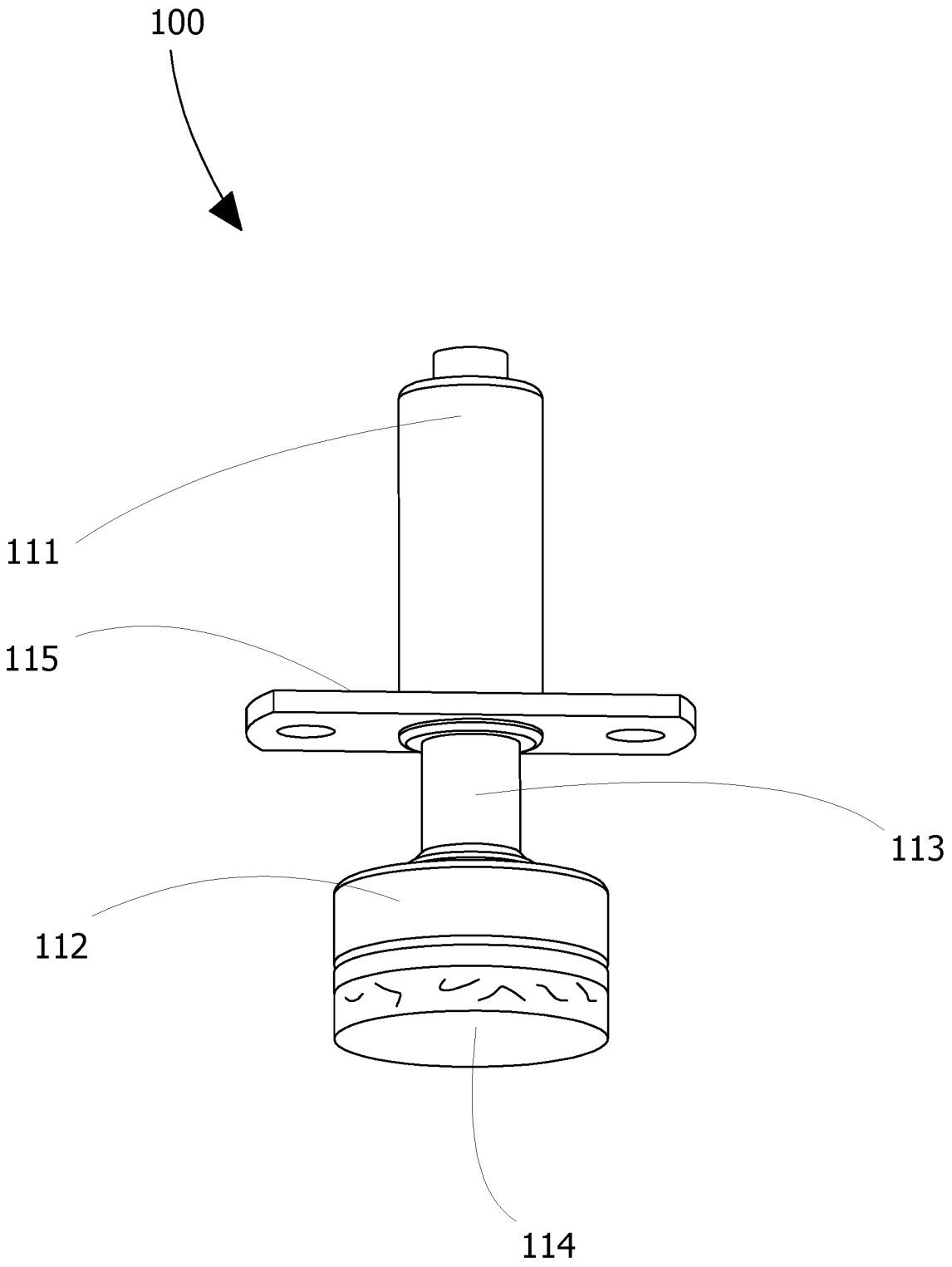
FIG. 11 is another perspective view of the door stop of FIG. 9.
Figure 12:
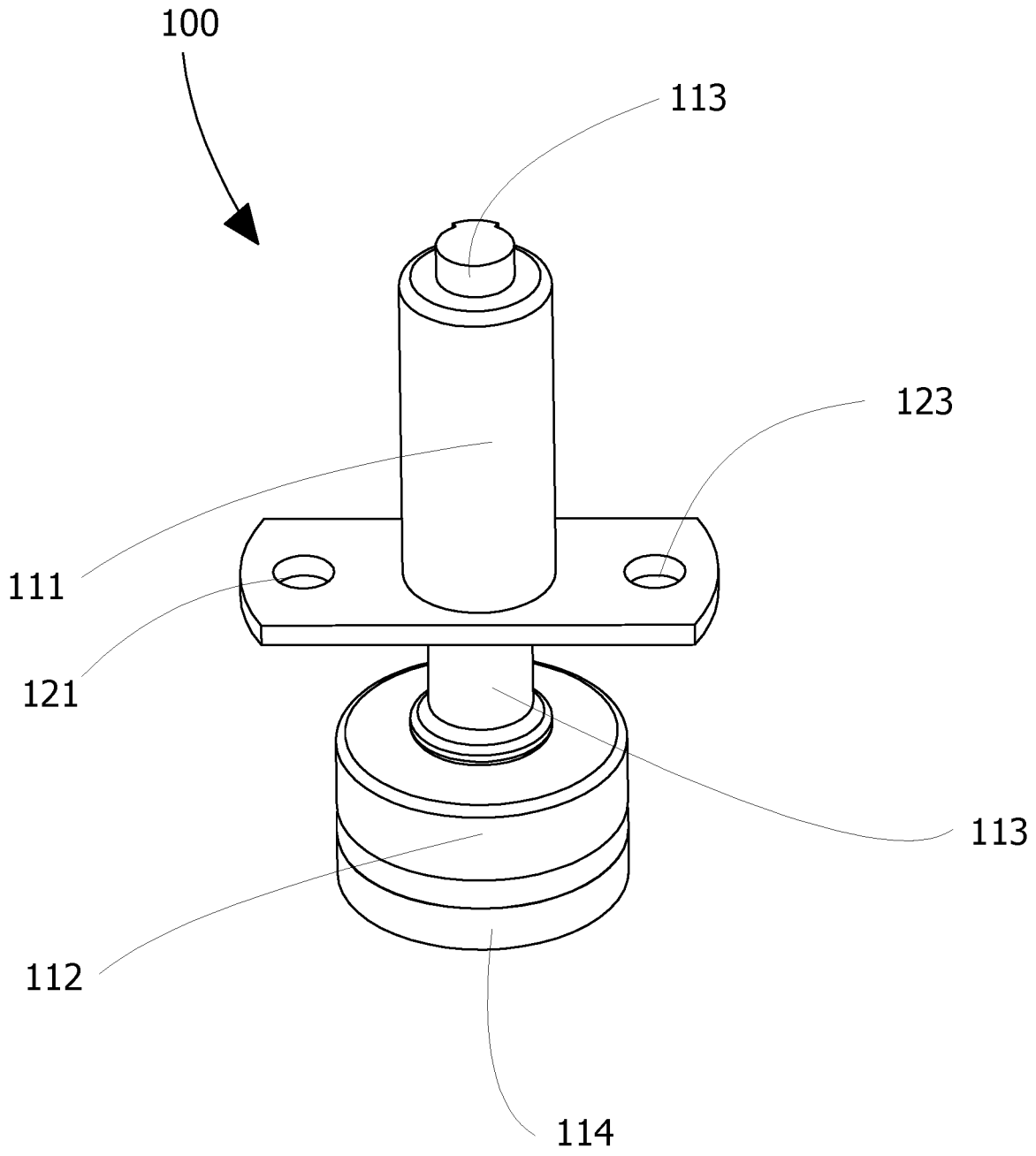
FIG. 12 is another perspective view of the door stop of FIG. 9.
Figure 13:
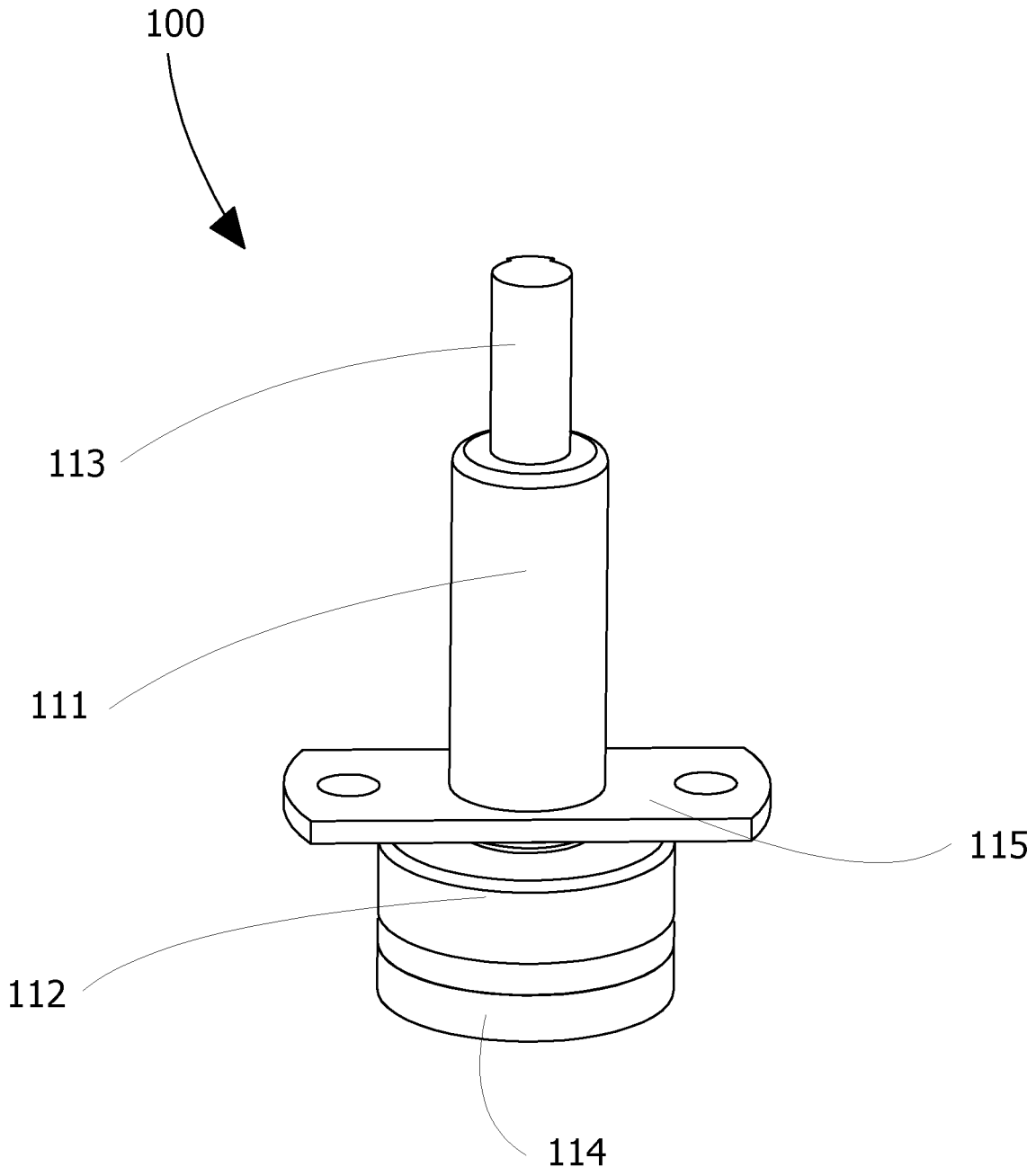
FIG. 13 is another perspective view of the door stop of FIG. 9.

A door stop according to another preferred embodiment of the invention is illustrated in FIGS. 9-13, and shown generally at reference numeral 100. As shown in FIG. 9-11, the door stop 100 comprises a spring-loaded member 111, and an elongate rod 113 telescopically positioned within the spring-loaded member 111 adapted for sliding movement within the spring-loaded member 111. The door stop 100 can include a mounting panel 115. The spring-loaded member 111, the rod 113 and the mounting panel 115 can be made of steel or other suitable material.

The spring-loaded member 111 can be comprised of a substantially hollow, cylindrical body, and a coil spring contained within the body. The housing includes a circular opening for receiving the elongate rod 113 that can be attached to the coil spring.

A substantially flat and circular head section 112 is positioned at one end of the rod 113, as shown in FIGS. 9-11. The head section 112 can be attached to the rod 113 by an adhesive or other suitable attachment means. Alternatively, the head section 112 can be an integrally formed with the rod 113. The head section 112 can be made of plastic or other suitable material. A cushioning member 114 can be attached to the outer surface of the head section 112, as shown in FIGS. 9-11. The cushioning section 114 can be made of felt, polyurethane foam or other soft, non-abrasive material. The cushioning section 114 can be attached to the head section 112 by an adhesive or other suitable attachment means.

The mounting panel 115 has three round holes 121, 122, 123 formed therein and positioned linearly, as shown in FIG. 10. The center hole 122 is shaped and sized to receive the rod 113 there through, as shown in FIG. 10.

Figure 14:
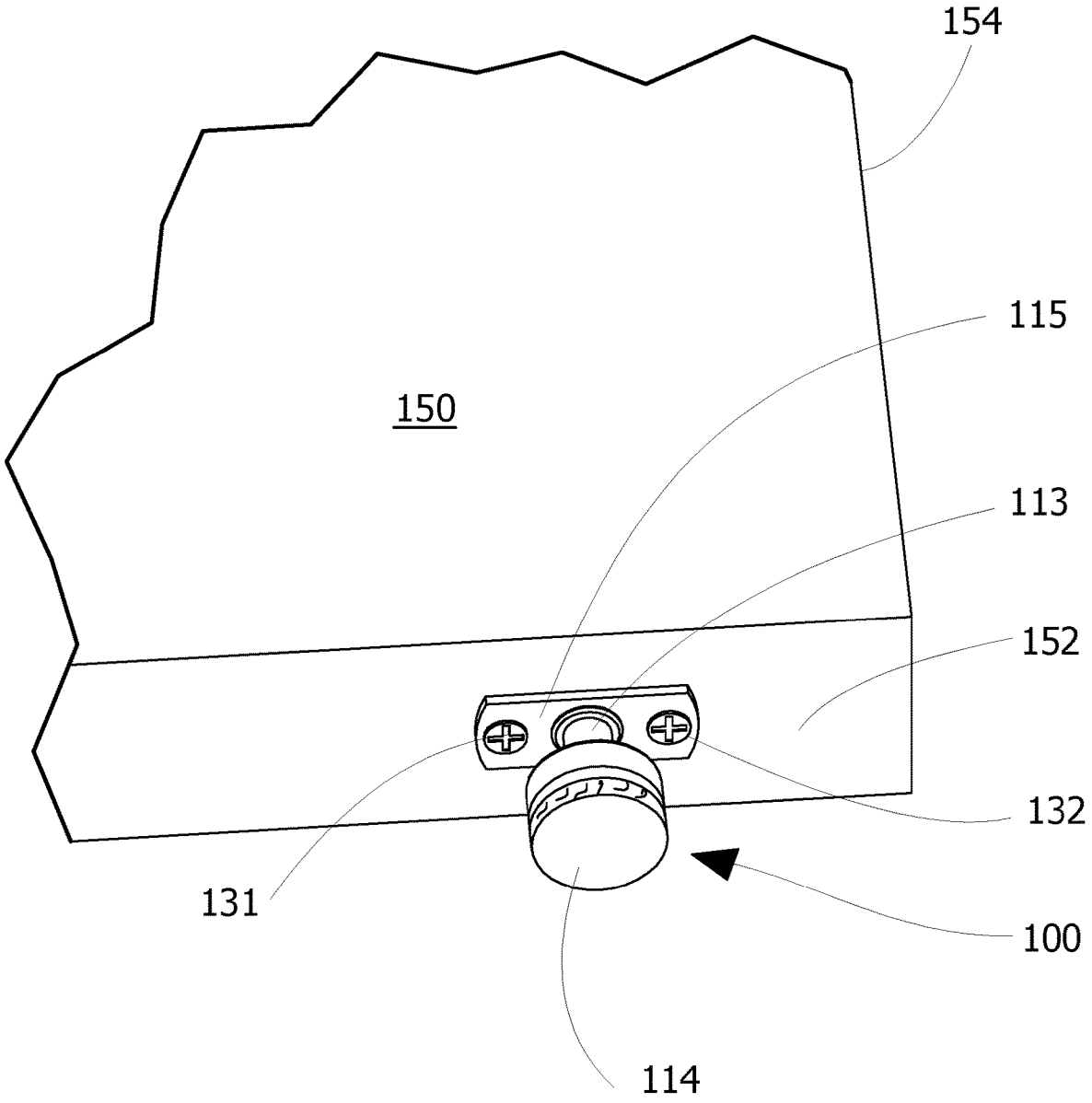
FIG. 14 is an environmental view of the door stop of FIG. 9.

In a method of using the door stop 100 according to a preferred embodiment of the invention, the door stop 100 can be attached at the bottom edge 152 of a door 150 proximate the side edge 154 on which the door hinges 156 are attached, as shown in FIG. 14. If the door 150 is already hinged to the wall, then it should be removed prior to attaching the door stop 100.

A cavity can be formed in the bottom edge 152 of the door 150 to receive the spring-loaded member 111 therein. The cavity can be formed using a drill or other suitable means. The spring-loaded member 111 is positioned within the cavity in the bottom edge 152 of the door 150, with the mounting panel 115 positioned flat against the bottom edge 152 of the door 150, as shown in FIG. 14. Fastening members such as screws 131, 132 are positioned through the left and right side openings 121, 123 of the mounting panel 115, and screwed into the bottom edge 152 of the door 150 to securely attach the door stop 100 to the door 50, as shown in FIG. 14.

Figure 15:
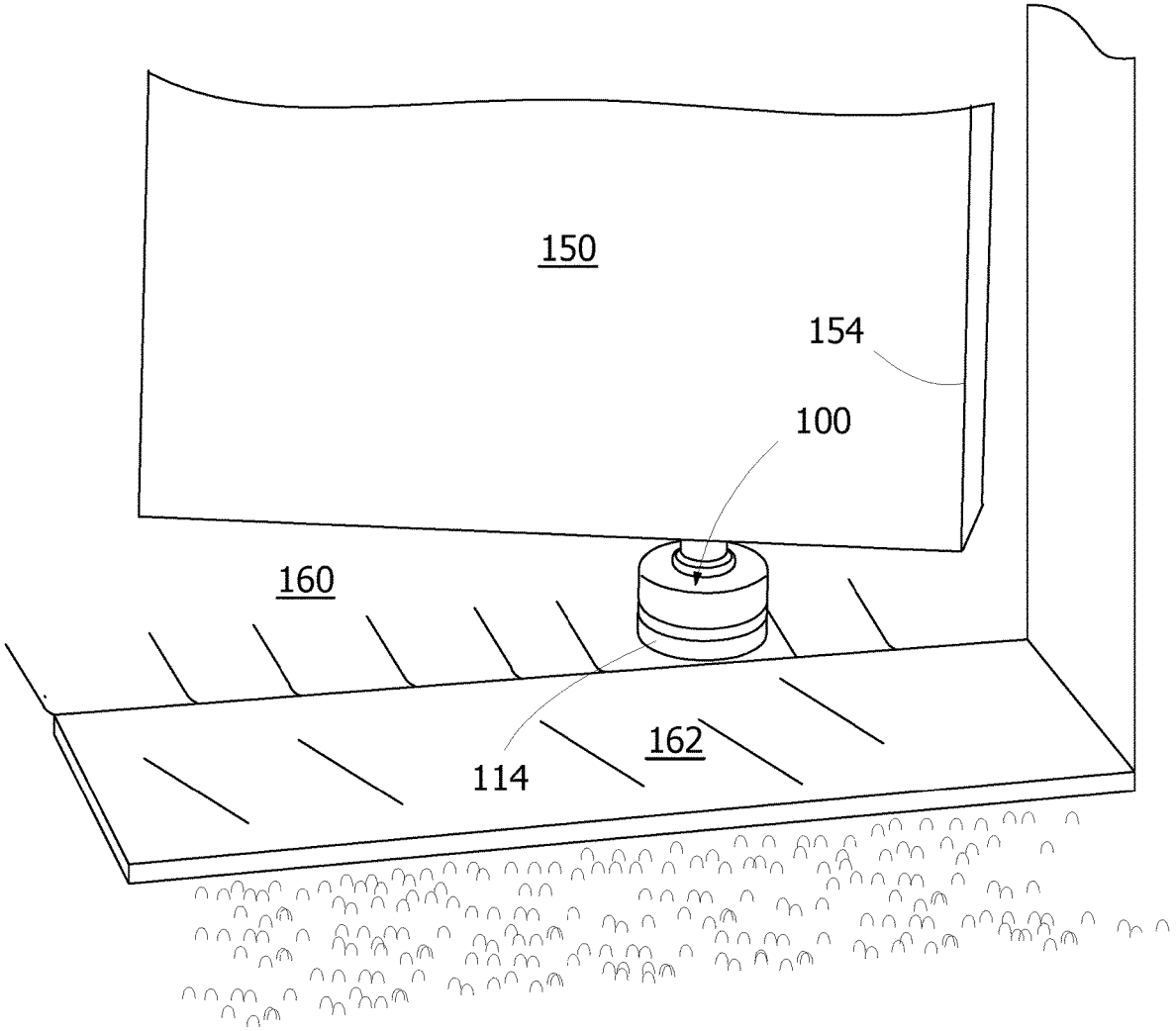
FIG. 15 is another environmental view of the door stop of FIG. 9.
Figure 16:
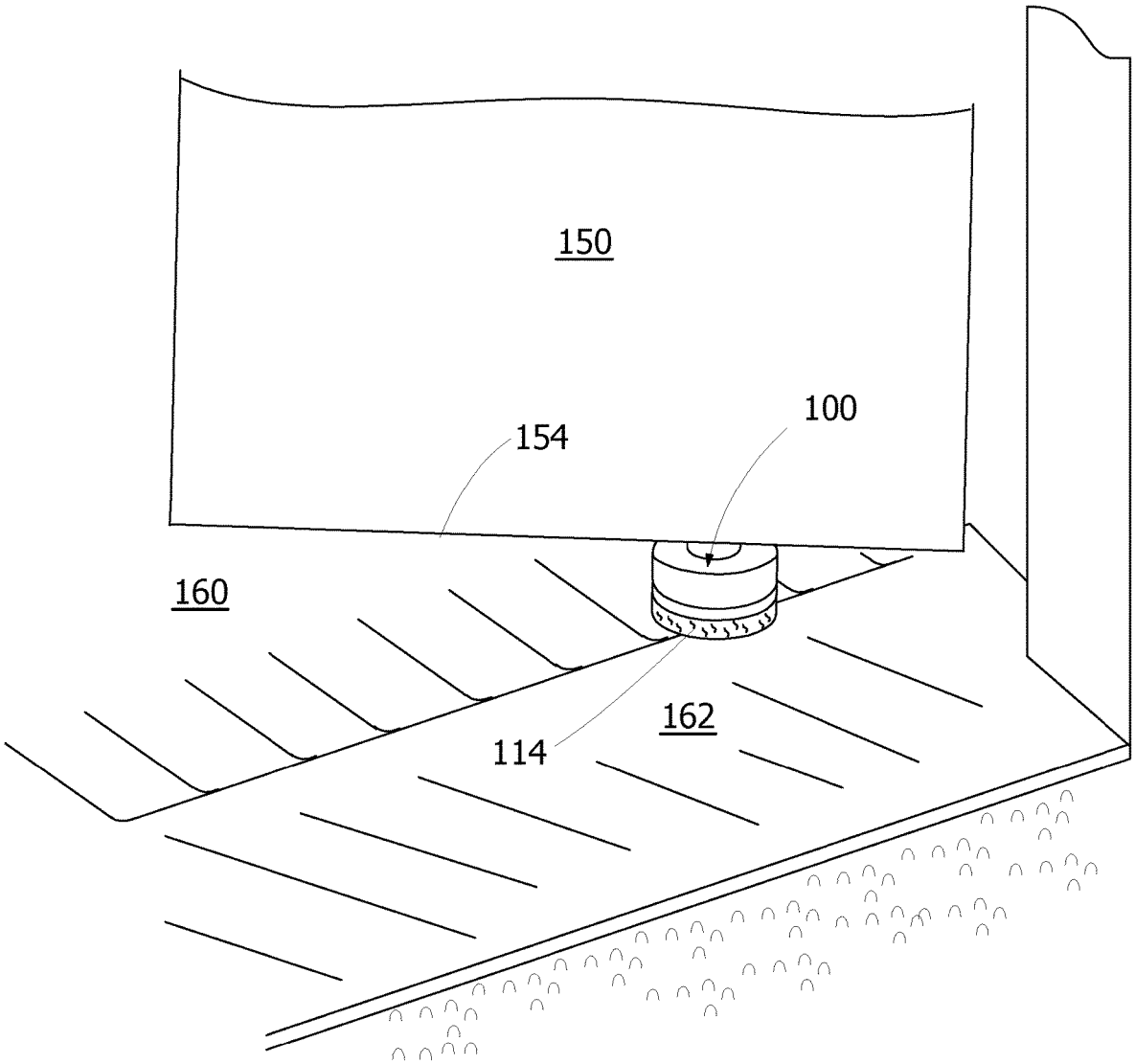
FIG. 16 is another environmental view of the door stop of FIG. 9.
Figure 17:
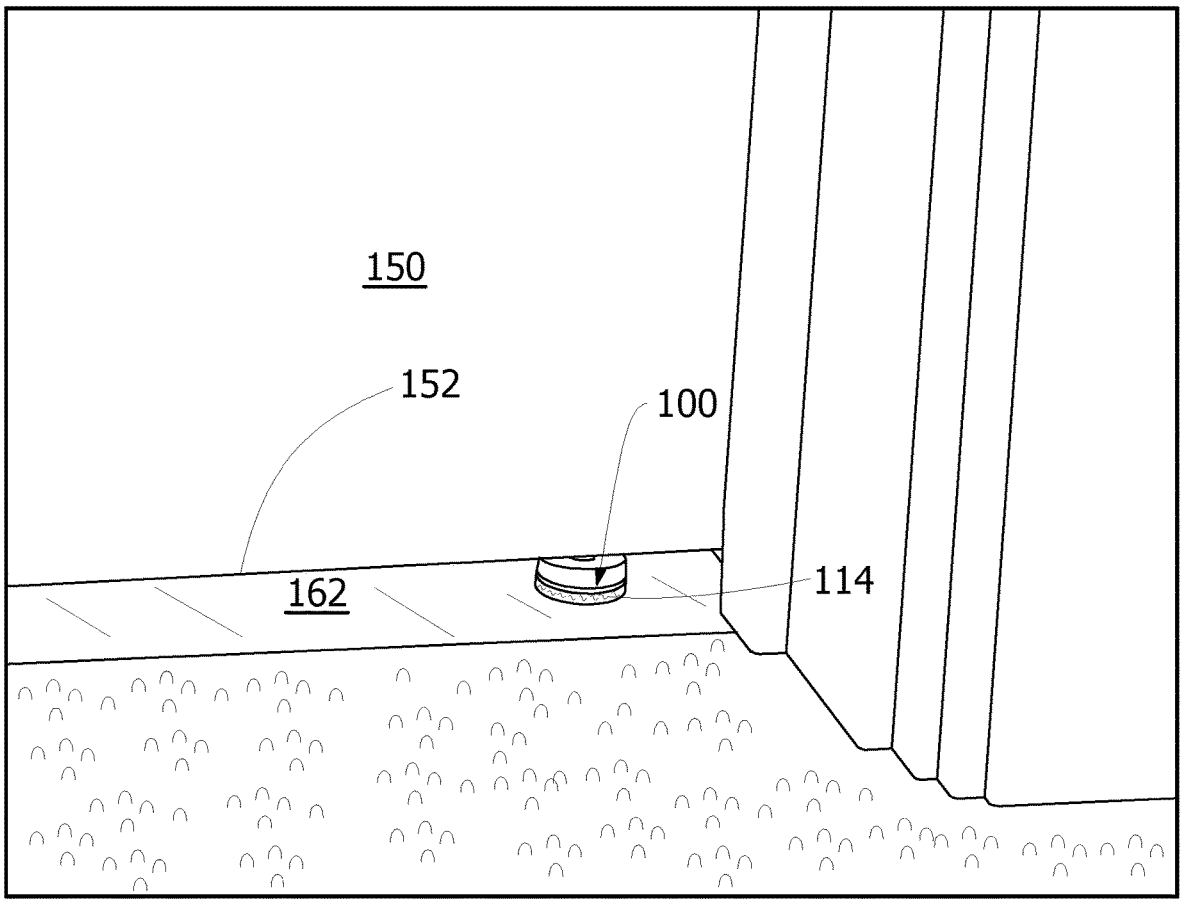
FIG. 17 is another environmental view of the door stop of FIG. 9.

With the door stop 100 secured to the bottom edge 152 of the door 150, the door stop 100 can prevent unwanted movement of the door 150. As shown in FIG. 15, the cushioning section 114 contacts the floor 160 and provides a level of frictional engagement that keeps the door 50 in a fixed position when not being moved by a person. The cushioning section 114 provides a level of frictional engagement such that the door 150 can be opened and closed when reasonable force is applied to the door, but stops the door 50 when a person is not moving the door 150. The soft material of the cushioning section 14 prevents the door stop 100 from scratching the floor 160.

The door stop 100 can be used on a floor 160 having an object thereon that is higher than the rest of the floor 160, such as a saddle or sill plate 162. When the door stop 100 is moved to the sill plate 162, the spring-loaded member 111 allows for the rod 113 to be pushed upwardly by the sill plate 162 just enough so that the sill plate 162 does not prevent further movement of the door stop 100 by the user, while maintaining contact between the cushioning section 114 of the door stop 100 and the sill plate 162, as illustrated by FIGS. 12-13 and 15-17.

A door stop and a method of using same are described above. Various changes can be made to the invention without departing from its scope. The above description of various embodiments of the invention are provided for the purpose of illustration only and not limitation—the invention being defined by the claims and equivalents thereof.

What is claimed is:

1. A door stop apparatus comprising:

(a) an elongate threaded member having a substantially flat head section positioned at one end of the elongate threaded member;

(b) a locking nut carried on the threaded member and threadingly engaged to the threaded member;

(c) a mounting panel having a central opening formed therein for receiving the threaded member therethrough, the mounting panel carried on the threaded member intermediate the locking nut and the head section of the threaded member and positioned adjacent to the locking nut, the mounting panel adapted for attachment to a bottom edge surface of a door, wherein a distance from the mounting panel to the head section is adjustable by moving the locking nut on the threaded member; and (d) wherein the door stop apparatus constantly holds the door in place at any position between a fully open position and a fully closed position by frictional engagement with a floor surface without affecting integrity of the door.

2. The door stop apparatus according to claim 1, further comprising a cushioning section positioned on an outer surface of the head section, and adapted for frictionally engaging the floor surface.

3. The door stop apparatus according to claim 2, wherein the cushioning section comprises at least one material from the group consisting of felt and polyurethane foam.

4. The door stop apparatus according to claim 1, wherein the mounting panel comprises first and second apertures formed therein, the central opening positioned intermediate the first and second apertures, and further comprising a first fastening member positioned through the first aperture and a second fastening member positioned through the second aperture, wherein the first fastening member and the second fastening member are adapted for being inserted into the bottom edge surface of the door, whereby the mounting panel is attached to the bottom edge surface of the door.

5. The door stop apparatus according to claim 4, wherein the first fastening member comprises a first wood screw, and the second fastening member comprises a second wood screw.

6. The door stop apparatus according to claim 1, wherein the threaded member and the mounting panel are comprised of steel.

7. The door stop apparatus according to claim 1, wherein the locking nut is comprised of at least one material selected from the group consisting of nylon and plastic.

8. The door stop apparatus according to claim 1, wherein the elongate threaded member is selected from the group consisting of a flat head bolt and an elevator bolt.

9. A door stop apparatus comprising:

(a) a spring-loaded member;

(b) an elongate rod, a first portion of the elongate rod telescopically positioned within the spring-loaded member and adapted for sliding movement within spring loaded member, a second portion of the elongate rod positioned outside of the spring-loaded member;

(c) a mounting panel attached to the spring-loaded member, the mounting panel adapted for attaching to a bottom edge surface of a door; and (d) a head section positioned on the second portion of the elongate rod, the head section frictionally engaging a floor surface, wherein the doorstop apparatus constantly holds the door in place at any position between a fully open position and a fully closed position without affecting integrity of the door.

10. The door stop apparatus according to claim 9, wherein a distance from the head section to the mounting panel is adjustable by sliding movement of the elongate rod.

11. The door stop apparatus according to claim 10, wherein the mounting plate includes a central opening receiving the spring-loaded member therethrough.

12. The door stop apparatus according to claim 11, wherein the mounting plate further includes first and second apertures formed therein, the central opening positioned intermediate the first and second apertures, and further comprising a first fastening member positioned through the first aperture and a second fastening member positioned through the second aperture, wherein the first fastening member and the second fastening member are adapted for being inserted into the bottom edge surface of the door, whereby the mounting plate is attached to the bottom edge surface of the door.

13. The door stop apparatus according to claim 12, wherein the first fastening member comprises a first wood screw, and the second fastening member comprises a second wood screw.

14. The door stop apparatus according to claim 9, further comprising a cushioning section comprising a non-abrasive material positioned on an outer surface of the head section.

15. The door stop apparatus according to claim 14, wherein cushioning section comprises at least one non-abrasive material selected from the group consisting of felt and polyurethane foam.

16. A door apparatus comprising:

(a) a door comprising a hinge for connecting the door to a structure, the structure including a floor surface; and (b) a door stop comprising:

(i) a spring-loaded member, (ii) an elongate rod, a first portion of the elongate rod telescopically positioned within the spring-loaded member and adapted for sliding movement within the spring-loaded member, a second portion of the elongate rod positioned outside of the spring-loaded member, (iii) a mounting panel connected to the spring-loaded member, and attached to a bottom edge surface of the door, and (iii) a head section positioned on the second portion of the elongate rod, and frictionally engaging the floor surface, whereby the door stop constantly holds the door in place between a fully open position and a fully closed position without affecting the integrity of the door.

17. The door apparatus according to claim 16, wherein a vertical axis defined by the hinge is not co-linear with a vertical axis defined by the door stop.

18. The door apparatus according to claim 16, wherein the mounting panel includes a central opening receiving the spring-loaded member therethrough and first and second apertures, the central opening positioned intermediate the first and second apertures and further comprising a first fastening member positioned through the first aperture and a second fastening member positioned through the second aperture, wherein the first fastening member and the second fastening member are inserted into the bottom edge surface of the door, whereby the mounting panel is attached to the bottom edge surface of the door.

19. The door apparatus according to claim 16, further comprising a cushioning section positioned on an outer surface of the head section, the cushioning section comprised of at least one selected from the group consisting of felt and polyurethane foam.

* * * * *